United States Patent [19]

Kraft et al.

[11] 4,043,430

[45] Aug. 23, 1977

[54] ELEVATOR SYSTEM HAVING COMMON ENCLOSURE FOR OPEN WIRING BETWEEN DOOR CONTROLS, CAR TOP INSPECTION STATION CONTROLS AND TRAVELING CABLE

[75] Inventors: Joseph K. Kraft; Robert A. Sette, both of Gettysburg; Leigh F. Jackson, Fayetteville, all of Pa.

[73] Assignee: Westinghouse Electric Corporation, Pittsburgh, Pa.

[21] Appl. No.: 684,060

[22] Filed: May 6, 1976

Related U.S. Application Data

[62] Division of Ser. No. 608,481, Aug. 28, 1975, Pat. No. 4,004,655.

[51] Int. Cl.[2] ..... B66B 13/00

[52] U.S. Cl. ..... 187/52 R; 187/1 R; 187/29 R

[58] Field of Search ..... 187/1 R, 29 R, 52 R

[56] References Cited

U.S. PATENT DOCUMENTS

| | | | |
|---|---|---|---|
| 2,017,547 | 10/1935 | Pavone | 187/29 R |
| 2,900,521 | 8/1959 | Eames | 187/52 R |
| 3,342,288 | 9/1967 | Vogel et al. | 187/1 R |
| 3,707,205 | 12/1972 | Gibson | 187/1 R |

*Primary Examiner*—Evon C. Blunk
*Assistant Examiner*—Jeffrey V. Nase
*Attorney, Agent, or Firm*—D. R. Lackey

[57] ABSTRACT

An elevator system including an elevator car an enclosure on top of the elevator car, a passenger opening in the elevator car, a door operable between open and closed positions relative to the passenger opening, a door operator for the door a car top inspection station, and a traveling cable. Controls for the door operator are mounted within the enclosure, and controls for the car top inspection station are mounted on a side of the enclosure. The traveling cable is connected to the enclosure. Open wiring in the enclosure interconnects the electrical components of the door operator, the car top inspection station, and the conductors of the traveling cable.

1 Claim, 4 Drawing Figures

ELEVATOR SYSTEM HAVING COMMON ENCLOSURE FOR OPEN WIRING BETWEEN DOOR CONTROLS, CAR TOP INSPECTION STATION CONTROLS AND TRAVELING CABLE

This is a division, of application Ser. No. 608,481 filed Aug. 28, 1975, now U.S. Pat. No. 4,004,655.

BACKGROUND OF THE INVENTION

1. Field of the Invention

The invention relates in general to elevator systems, and more specifically to new and improved arrangements for interconnecting certain of the electrical controls associated with an elevator car.

2. Description of the Prior Art

Elevator systems for transporting passengers between spaced floors or landings of a building, all utilize an elevator car having one or more doors operable between open and closed positions by a door operator mechanism, to enable passengers to enter and leave the elevator car at each floor. The door operator mechanism should be easy to install and maintain, it should be compact, it should have a low manufacturing cost, and it should be light in weight without compromising vertical support and horizontal stability. The weight of the door operator is especially important in hydraulic elevator systems, where the total weight of the elevator car must be lifted by the hydraulic jack and its power supply. If the weight of the elevator car can be reduced in a hydraulic elevator system, the size of the hydraulic jack, hydraulic pump, and the electric drive motor for the pump may all be reduced, which thus reduces the initial or manufacturing cost of the system, and it reduces the operating costs due to lower energy requirements.

Thus, it would be desirable and it is the object of this invention to significantly reduce the weight and cost of an elevator car.

SUMMARY OF THE INVENTION

Briefly, the present invention is a new and improved elevator system which includes an elevator car having a passenger opening, a door operable to open and close the passenger opening, and a door operator mechanism disposed to impart linear motion to the door. The door operator mechanism includes a channel shaped base frame member which may be mounted directly to the top of the car, adjacent the side of the passenger opening. The base frame member cooperates with the structure which forms the top of the elevator car to provide vertical support for the door operator and doors, horizontal stability which resists the inertial force of the door motion, and it adds rigidity to the top of the elevator car.

A removable cover is disposed over the base frame member to provide an enclosure for the components of the door operator mechanism, which enclosure also functions as a wiring trough or duct permitting open wiring between such electrical components as the door operator drive motor, speed control and limit switches, speed control resistors, radiant energy object detector control, emergency lighting controller, alarm bell, and other associated control circuitry. Thus, costly conduit runs between these components are eliminated. This enclosure also functions as an electrical junction box for traveling cable conductors, and conductors to other electrical equipment mounted on the car. The need for separate electrical junction boxes is thus eliminated.

The cover overlaps the leg of the base frame member which forms the hanger wheel track to provide a slot for receiving and allowing linear motion of the hanger plates which are attached to the doors, and a cam member is mounted on a hanger plate for direct one-to-one operation of the speed control and limit switches which are associated with the open and closed positions of the door.

The base frame member functions as a common support for the various electrical and mechanical components of the door operator, facilitating installation of the door operator. The cover, when removed, affords complete, open access to all apparatus mounted on the base frame member for easy adjustment and maintenance.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
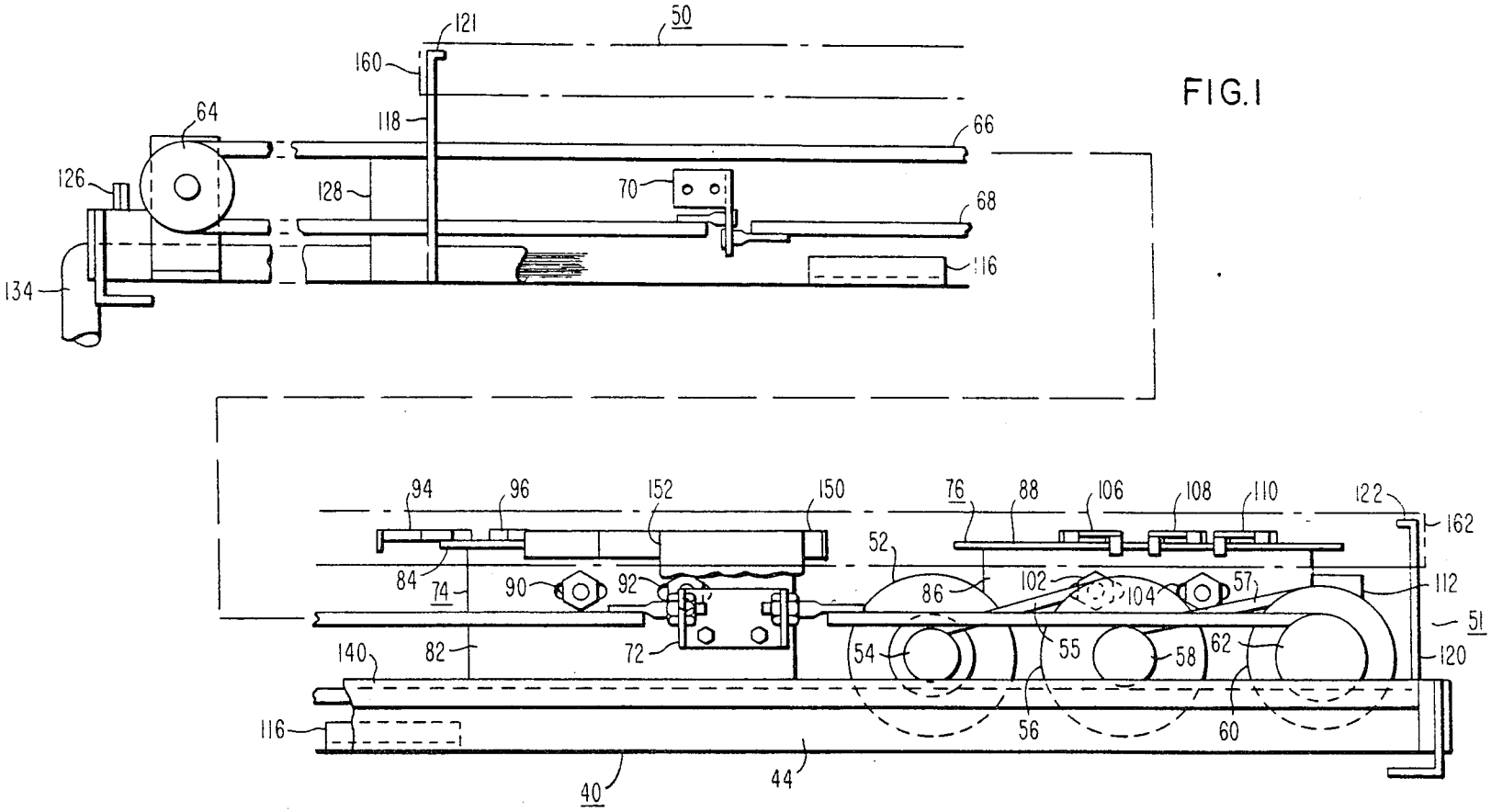
FIGS. 1, 2 and 3 are front elevational, plan, and end views, respectively, of a closure system constructed according to the teachings of the invention.
Figure 2:
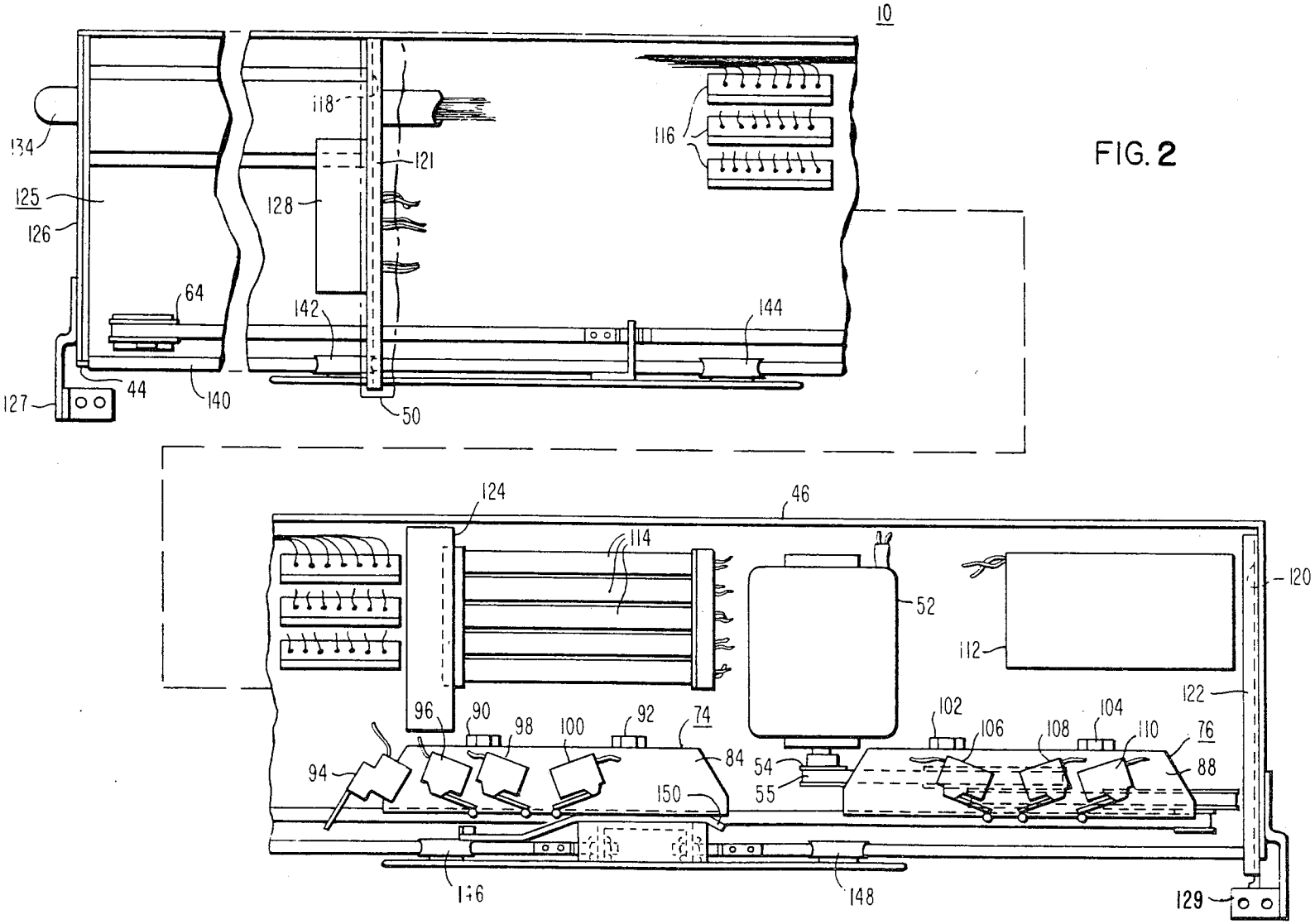
Figure 3:
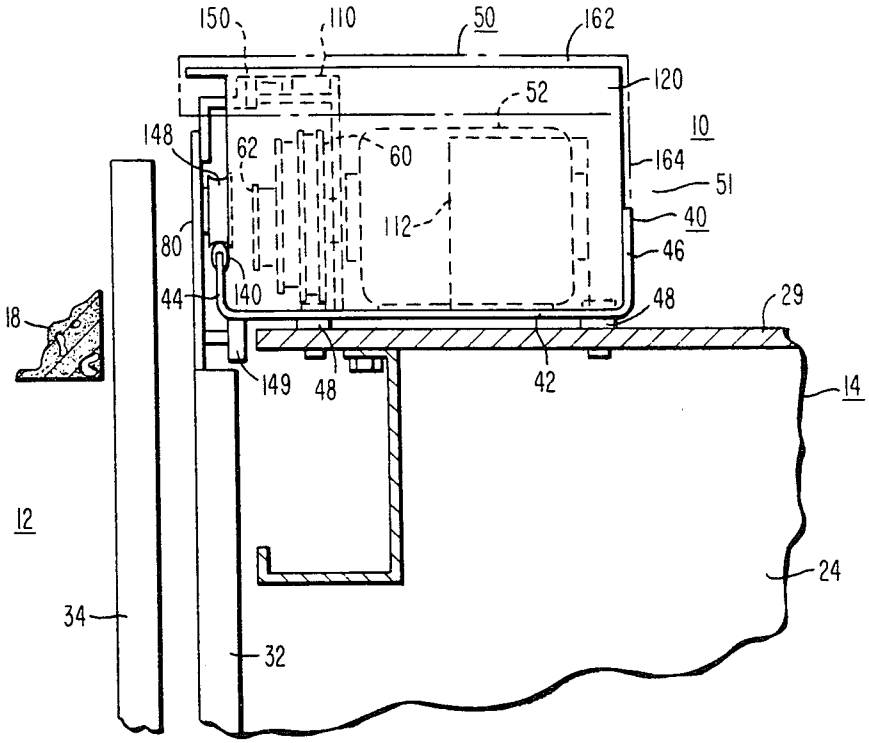
Figure 4:
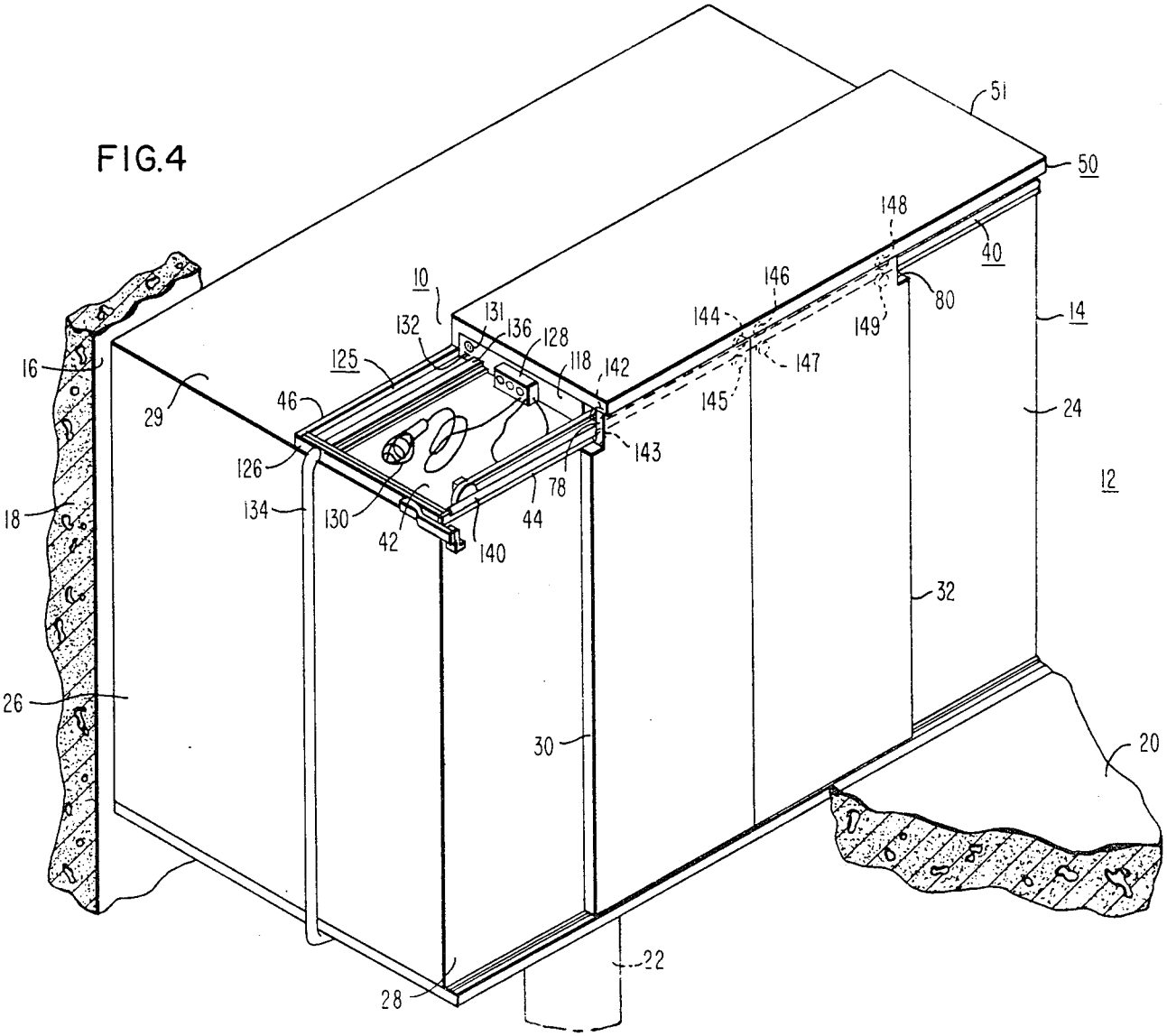
FIG. 4 is a perspective view of an elevator system including an elevator car and the closure system shown in FIGS. 1, 2 and 3, which cooperatively provide a new and improved elevator system.

Referring now to the drawings, FIGS. 1, 2 and 3 illustrate front, plan, and end views, respectively, of a new and improved closure system 10, and FIG. 4 is a perspective view of an elevator system 12 which includes the closure system 10 of FIGS. 1, 2 and 3. The elevator system 12 includes an elevator car 14 mounted for vertical movement in the hoistway 16 of a structure 18 to serve the floors therein, such as the floor 20. While the elevator system may be of the traction type, the invention is particularly well suited to elevators of the hydraulic type, and, for purposes of example, it will be assumed that the elevator system is a hydraulic elevator which includes a jack 22 fastened to the bolster plate at the bottom of the elevator car 14.

The elevator car 14 includes an enclosure 24, the outside of which may be constructed of sheet steel members which define a bottom, four sides, such as sides 26 and 28, and a top 29. One of the sides, such as side 28, includes a passenger opening and car doors 30 and 32. The invention applies to an elevator car having one or more doors. Two doors for a center opening car are illustrated, for purposes of example. The car doors 30 and 32, when operated, include conventional vane and drive block apparatus (not shown) for engaging the hoistway doors at each floor, such as the hoistway door shown in FIG. 3, to operate the hoistway doors in unison with the car doors 30 and 32.

The closure system 10 includes a metallic, channel shaped base frame member 40 having a bight portion 42 and first and second upstanding leg portions 44 and 46, respectively. The base frame member 40 is mounted directly to the top 29 of the elevator car 14, with the length of the base frame member 40 being sufficient to extend substantially across the entire width of the side of the car which includes the passenger entrance. The base frame member 40 is mounted with its first leg portion 44 overhanging the passenger entrance side of the car by a predetermined dimension, as shown in the end view of the closure system in FIG. 3. This exposes a predetermined portion of the underside of the bight 42, for purposes which will be hereinafter explained.

If the top 29 is flat, as illustrated in the FIGURES, the base frame member 40 is preferably mounted directly to the car top 29 with a plurality of grommet type vibration and sound isolation fasteners 48. If the top 29 includes reinforcing ribs, the base frame member 40 is mounted to the top with standoff brackets. Bolting the channel shaped base frame 40, which extends completely across the front of the car, directly to the car top, provides vertical support for the door operator and car doors and provides the required horizontal stability, thus eliminating the need for additional structural and support members.

The base frame member 40, in addition to its structural function, provides a support base for all of the components of the closure system. It also cooperates with a cover portion 50 to provide an enclosure 51 for these components, which enclosure also functions as a wiring duct for the components of the closure system, the car maintenance and inspection station, the emergency lighting controller, alarm bell, and for electrical components within the elevator cab, such as a fan and lamps. Thus, open electrical wiring may be used between electrical components, eliminating costly conduit runs. The enclosure also functions as an electrical junction box for the car equipment and electrical traveling cable conductors, thus eliminating the cost of separate junction boxes.

The components of the closure system 10 are all mounted on the base frame member 40. These components include the electrical drive motor 52 and belt reduction drive arrangement which includes pulleys 54, 56, 58 and 60, and belts 55 and 57, which drive the linear portion of the door operator drive. The linear drive portion includes spaced pulleys 62 and 64, relating cable 66, and V-belt 68. Pulley 62 is driven by pulley 60 and is disposed at one end of the base frame member 40 and pulley 64, which is an idler pulley, is disposed at the opposite end of the base frame member 40. The relating cable 66 and V-belt 68 are interconnected via door hanger brackets 70 and 72. Door hanger brackets 70 and 72 are directly connected to hangers 78 and 80, respectively, shown in FIG. 4, which are welded or otherwise suitably attached to the doors 30 and 32, respectively.

The closure system 10 additionally includes position or speed control and limit switches mounted on bracket assemblies 74 and 76. Bracket assembly 74 includes an L-shaped bracket 82 which is fastened to the bight 42 of the base frame member 40, and an L-shaped bracket 84 which is adjustably mounted to the top portion of the bracket 82 via fasteners 90 and 92. The openings in one of the brackets 82 or 84 are slotted to provide adjustment of bracket 84 in a direction parallel to the direction of door motion. Speed control, limit and gate contact switches 94, 96, 98 and 100 associated with the closed position of the doors are accurately mounted on bracket 84. Thus, the positions of all of the switches associated with door closure may be simultaneously adjusted.

Bracket assembly 76 includes an L-shaped bracket 86 which is fastened to the base frame member 40, and an L-shaped bracket 88 which is adjustably mounted to the top portion of the bracket 86 via fasteners 102 and 104. Speed control and limit switches 106, 108 and 110 associated with the open position of the doors are accurately mounted on bracket 88. Thus, the positions of all of the switches associated with the opening of the door may be simultaneously adjusted.

All other mechanical and electrical components associated with the closure system 10 are mounted on the base frame member 40, such as control 112 for operating a radiant beam object detector mechanism, resistors 114 associated with the door speed control circuits, and terminal blocks 116. Since the actual door control circuitry used in the closure system 10 may be conventional, it is not shown schematically. For example, the control circuitry shown in U.S. Patent No. 2,900,521, which is assigned to the same assignee as the present invention, may be used.

First and second end members or portions 118 and 120, respectively, are provided which extend across the bight 42 perpendicular to the inner surfaces of the first and second leg portions 44 and 46. The end portions 118 and 120 extend upwardly beyond the height of the first and second leg portions to provide a support for the cover 50 of the enclosure 51. L-shaped support members 121 and 122 are formed integral with the top edges of the upstanding end portions 118 and 120, respectively, in order to provide additional support for the cover 50. A support bracket 124 shown in FIG. 2 is provided between the end portions for providing still further support for the cover 50, enabling the cover 50 to support the weight of maintenance personnel.

As illustrated in FIGS. 1 and 2, the first end portion 118 may be set in from the left-hand end of the base frame member 40 by a predetermined dimension, to provide a car top inspection and maintenance station 125. End piece members 126 and 120, provided at the extreme ends of the base frame member 40, serve as attachment points for door stop brackets 127 and 129, respectively.

The electrical components of the inspection station 125 are all mounted on the first end portion 118, permitting the common enclosure 51 to house the wiring for these components of the inspection station, making it unnecessary to provide a separate enclosure for the car inspection station, and eliminating a conduit run to the car inspection station. The car inspection station 125, best shown in FIG. 4, includes such components as a portable pushbutton station 128, a lamp 130, an electrical receptacle 131 and a switch 132 for switching to car top control of the elevator system. The space on the upper surface of the bight 42 between end member 126 and end portion 118 provides a tray in which the lamp 130 and pushbutton station 128 may be disposed.

A traveling cable 134, which includes electrical power and control conductors, may be directed from the traveling cable hanger at the bottom of the elevator car 12, up side 26 of the car, through suitable grommets disposed in side members 126 and 118, and to selected terminals of the terminal blocks 116. A cover 136 may be disposed over the traveling cable 134 as it proceeds through the tray portion of the inspection station. Thus, enclosure 51 is the electrical junction box for the conductor of the traveling cable 134.

The upper edge of the first leg portion 44 of the base frame member 40 is provided with a non-metallic tight fitting member 140 which is pressed on the upper edge to provide a smooth, non-metallic riding surface for hanger rollers 142, 144, 146 and 148. Member 140 may be a Nylon extrusion, or other suitable member having low friction characteristics.

Thus, the first leg portion 44 functions as the door hanger track for receiving the hanger rollers which are journaled to the hanger plates 78 and 80, which in turn are fastened to the doors 30 and 32.

Up thrust rollers 142, 144, 146 and 148 are journaled to the hanger plates 78 and 80. As best illustrated in FIG. 3, the up thrust rollers are located and oriented such that they contact the portion of the underside of the portion of the base member 40 which overhangs the top 48 of the cab. The up thrust rollers prevent the doors 30 and 32 from becoming disengaged from the hanger roller track, should the doors encounter an obstruction.

The cover 50 overhangs the first leg portion 44, best shown in FIG. 3, to provide a slot which is accessible from below for receiving and allowing linear motion of the hanger plates 78 and 80. A cam member 150 is mounted on the hanger plate 80 via a bracket member 152. Thus, the speed and limit switches which are mounted on bracket assemblies 74 and 76 have a direct, linear, one-to-one relationship between door motion and switch operation, which facilitates easy and precise adjustment of the switches.

The solid height portion of doors 30 and 32 was deliberately selected to be oversize in the vertical direction to minimize the required height of the hanger plates 78 and 80 and thus add additional stiffness to the doors. The hanger plates 78 and 80 are selected with a width dimension which is substantially as wide as their associated doors, which substantially closes the slot at the front of the enclosure 51 which receives the hanger plates.

The cover 50 is a sheet metal pan which may be constructed of aluminum to reduce its weight. The cover 50 is readily removed from its assembled position with the base frame member 40 without releasing fasteners, as it is held in place by gravity and an interlocking arrangement wherein end portions 160 and 162 of the cover 50 overlap the upstanding end portions 118 and 120, respectively, of the enclosure 51, while a depending back portion 164 of the cover 50 is aligned with the upstanding second leg portion 46 of the base frame member 40. The cover 50 is formed of a material which is of sufficient thickness, which, along with the cover supports hereinbefore mentioned, enables the cover to withstand the weight of maintenance personnel.

In summary, there has been disclosed a new and improved elevator system which includes an elevator car and closure system for opening and closing the passenger entrance or opening to the elevator car. The closure system includes an enclosure which provides a support, enclosure and wiring duct for the various electrical and mechanical components of the system, as well as functioning as an electrical junction box for the traveling cable conductors and other electrical equipment mounted in or on the cab and supporting structure. The enclosure is normally mounted directly to the car ceiling, providing vertical support and horizontal stability. The enclosure is constructed to provide an entegral door hanger roller track, an integral up thrust roller guide surface, and a removable cover to permit open access to all components for easy maintenance thereof. The enclosure also functions as the enclosure for a car top maintenance and inspection station, and by locating fans and lights in the cab below the enclosure, separate conduit runs to these items may be eliminated.

The resulting elevator system is lighter in weight than elevator systems of the prior art, which is especially important in hydraulic elevator systems where the full weight of the elevator car must be supported and lifted by the hydraulic jack. Thus, the size of the jack and its power supply, i.e. hydraulic pump and electrical motor, may all be reduced, resulting in reduced manufacturing cost. The elimination of conduit runs between the electrical components of the closure system, the elimination of separately mounted electrical junction boxes, and the multifunction base frame member which provides the integral door hanger track and guide surface for the thrust rollers, also substantially reduces manufacturing and installation costs. The closure system is compact, neat in appearance, and it facilitates maintenance since all components are enclosed and not subject to the normal buildup of dust and dirt, but yet they are easily accessible for maintenance.

We claim as our invention:

1. An elevator system, comprising:

an elevator car having side, bottom and top portions with a passenger opening in a side portion thereof, an enclosure on the top portion of said elevator car, door operator controls in said enclosure, said door operator controls including a drive motor, door position switches, and terminal blocks, a traveling cable having a plurality of conductors, at least certain of which enter said enclosure, and controls for a car top inspection station mounted on a wall of said enclosure, and open electrical wiring in said enclosure between said door operator controls, said controls for the car top inspection station, and said at least certain of the conductors of said traveling cable.

* * * * *